US005359258A

United States Patent [19]

Arkhipov et al.

[11] Patent Number: 5,359,258

[45] Date of Patent: Oct. 25, 1994

[54] PLASMA ACCELERATOR WITH CLOSED ELECTRON DRIFT

[75] Inventors: Boris A. Arkhipov, Kaliningrad; Andrey M. Bishaev; Vladimir M. Gavriushin, both of Moscow; Yury M. Gorbachov, Kaliningrad; Vladimir P. Kim; Vjacheslav I. Kozlov, both of Moscow; Konstantin N. Kozuesky; Nikolai N. Maslennikov, both of Kaliningrad; Alexei I. Morozov; Dominic D. Sevruk, both of Moscow, all of U.S.S.R.

[73] Assignee: Fakel Enterprise, Kaliningrad, U.S.S.R.

[21] Appl. No.: 866,149

[22] Filed: Apr. 9, 1992

[30] Foreign Application Priority Data

Nov. 4, 1991 [SU] U.S.S.R. ..... 5018122/25

[51] Int. Cl.[5] ..... H01J 1/52; F03H 1/00; H05H 1/00

[52] U.S. Cl. ..... 313/359.1; 313/361.1; 313/362.1; 313/313; 315/111.41; 60/202

[58] Field of Search ..... 313/359.1, 361.1, 362.1, 313/313; 315/111.41; 60/202

[56] References Cited

U.S. PATENT DOCUMENTS 3,546,513 12/1970 Henning ..... 313/361.1
5,132,597 7/1992 Goebel et al. ..... 313/359.1
5,218,271 6/1993 Egorov et al. ..... 315/111.41

FOREIGN PATENT DOCUMENTS

0463408A3 2/1992 European Pat. Off. ..... H05H 1/54

OTHER PUBLICATIONS

A. M. Bishaev and V. Kim, "Local Plasma Properties in a Hall-Current Accelerator with an Extended Acceleration Zone", Soviet Physics Technical Physics, vol. 23, No. 9, pp. 1055 through 1057, Sep. 1978, New York, U.S.

*Primary Examiner*—Donald J. Yusko
*Assistant Examiner*—Matthew J. Esserman
*Attorney, Agent, or Firm*—Edward J. Radlo; Greg T. Sueoka; Dennis S. Fernandez

[57] ABSTRACT

Internal and external magnetic screens made of magnetic permeable material are added between the discharge chamber and the internal and external sources of magnetic field, respectively. A longitudinal gap is maintained between the screens and their respective internal and external poles, that does not exceed half the distance between the internal and external poles. The exit end part of the internal magnetic screen is placed closer to the middle point of the accelerating channel than the internal pole. The walls of the exit end part of the discharge chamber are constructed with an increased thickness, and extend beyond the planes that the poles lay. The magnetic screens can be located with a gap relative to the magnetic path if connected by a bridge between the screens. The discharge chamber, the anode, and the magnetic system are symmetrically designed relative to two mutually perpendicular longitudinal planes. Thus, the external pole and the external screen are made into four symmetrical parts relative to the planes; and the external sources of the magnetic field are made with four magnetic coils, each coil connected with one part of the external pole. The discharge chamber is connected to the external pole with a holder at its front part. The holder, with the exception of the locations of attachment, is situated with a gap relative to the discharge chamber.

6 Claims, 2 Drawing Sheets

PLASMA ACCELERATOR WITH CLOSED ELECTRON DRIFT

TECHNICAL FIELD

The present invention relates to the field of plasma technology and can be used in the development of Accelerators with Closed Electron Drift (ACED) employed as Electric Propulsion Thrusters (EPT), or for ion plasma material processing in a vacuum.

BACKGROUND ART

There are known plasma thrusters or "accelerators" with a closed electron drift. These thrusters typically comprise a discharge chamber with an annular accelerating channel; an anode situated in the accelerating channel; a magnetic system; and a cathode. These thrusters are effective devices for ionization and acceleration of different substances, and are used as EPT and as sources of accelerated ion flows. However, they have a relatively low efficiency and insufficient lifetime to provide a solution of a number of problems.

The closest prior art approach to the present invention is a thruster with a closed electron drift comprising: a discharge chamber with an annular accelerating channel facing the exit part of the discharge chamber and formed by the inner and outer discharge chamber walls with closed cylindrical equidistant regions of working surfaces; an annular anode-distributor having small channels for a gas supply situated inside the accelerating channel at a distance from the exit ends of the discharge chamber walls that exceeds the width of the accelerating channel; a gas supply from the anode to the accelerating channel via a system of feedthrough holes on the anode exit surface; a magnetic system with external and internal poles placed at the exit part of the discharge chamber walls on the outside of the outer wall and inside the internal wall, respectively, to form an operating gap; a magnetic path with a central core, and with at least one outer and one inner source of magnetic field placed in the magnetic path circuit at the internal and external poles, respectively; and, a gas discharge hollow cathode placed outside the accelerating channel. This thruster also has the aforementioned deficiencies.

DISCLOSURE OF INVENTION

The present invention increases the thruster efficiency and lifetime, and decreases the amount of contamination in the flow by using an optimal magnetic field structure in the accelerating channel and improvements in thruster design. The present invention is a plasma thruster with closed electron drift comprising: a discharge chamber with an annular accelerating channel facing the exit part of the discharge chamber, the annular accelerating channel bounded by the internal and external walls of the discharge chamber with closed cylindrical equidistant regions of working surfaces and an exit part of the discharge chamber; an annular shaped anode gas-distributor situated inside of the accelerating channel at a distance from the exit plane of the discharge chamber exceeding the width of the accelerating channel with apertures for a gas supply to the accelerating channel via a feedthrough system of holes on the exit of the anode surface; a magnetic system with external and internal poles situated near the exit part of the discharge chamber walls, the external pole outside of the outer wall and the internal pole inside of the internal wall, and the poles forming an operating gap; a gas discharge hollow cathode placed outside the accelerating channel; and a magnetic path with a central core and at least one external and one internal source of magnetic field placed in the magnetic path circuit at the corresponding external and internal poles; the magnetic path made with additional internal and external magnetic conducting screens constructed of magnetically permeable material, the internal screen covering the internal source of magnetic field and placed with a longitudinal gap relative to the internal pole, and the external screen covering the external source of magnetic field and placed between the external source of magnetic field and the discharge chamber with a longitudinal gap between its cylindrical exit end part and the external pole; said longitudinal clearance gaps between the corresponding internal and external poles and magnetic screens not exceeding half of the operating gap between the poles.

BRIEF DESCRIPTION OF THE INVENTION

DETAILED DESCRIPTION OF THE PREFERRED EMBODIMENTS

Figure 1:
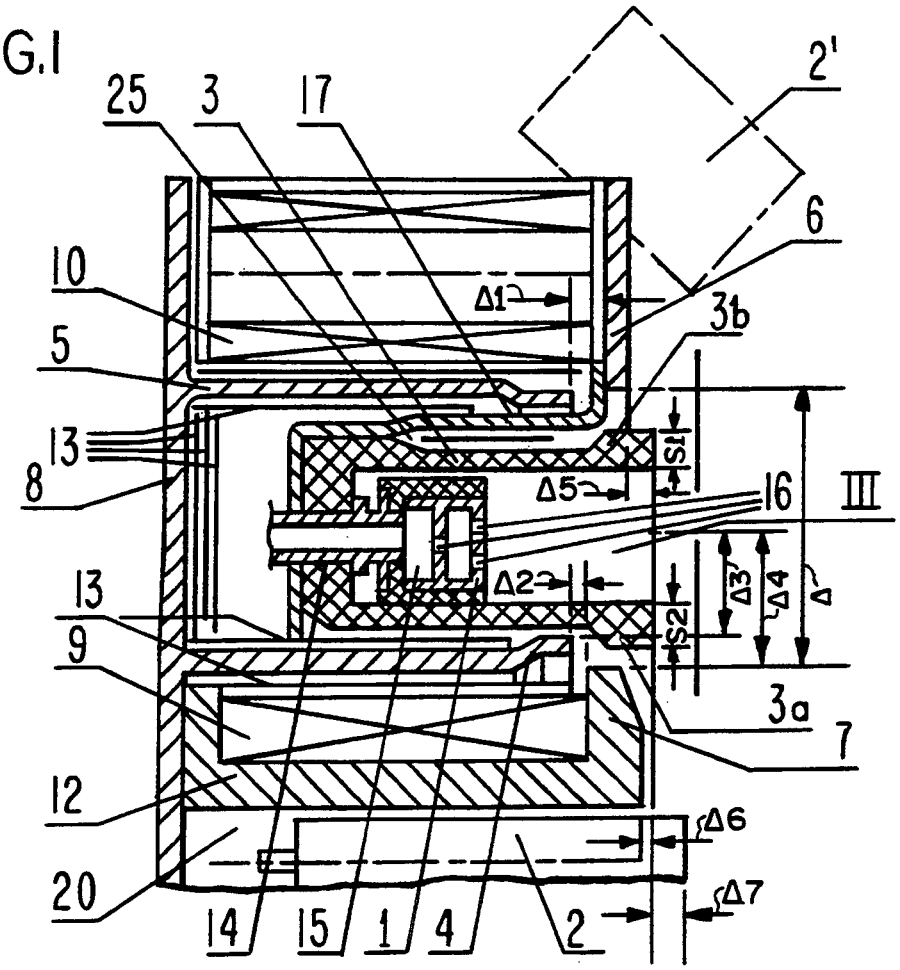
FIG. 1 is a cross-sectional view of the structure shown in FIG. 3 taken along the line I—I, showing a preferred embodiment of a plasma accelerator with closed electron drift constructed according to the present invention.
Figure 3:
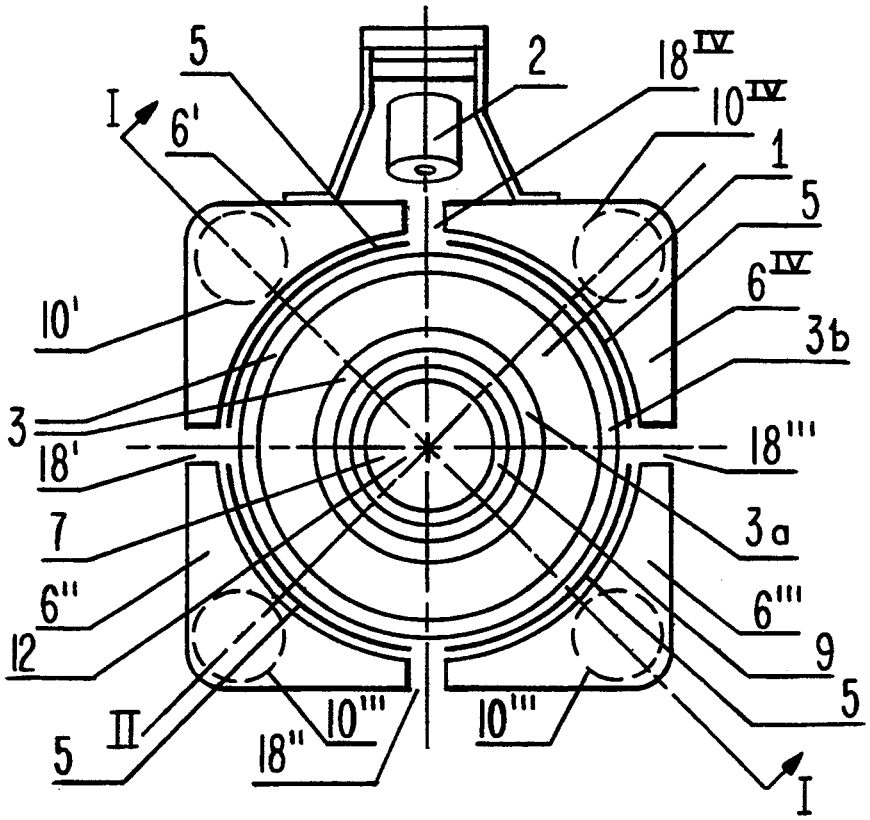
FIG. 3 is a schematic end view if a preferred embodiment of a thruster with magnetic poles and screens divided in four parts and equipped with four systems of magnetic coils.
Figure 4:
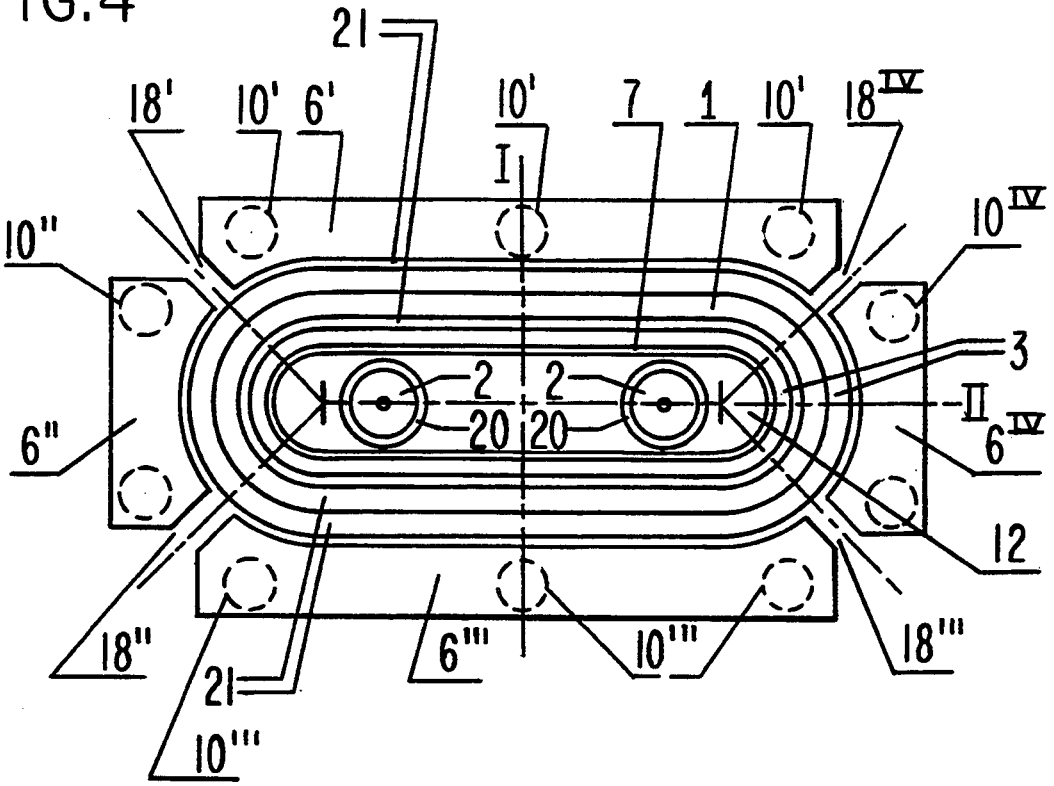
FIG. 4 shows a schematic end view if an alternate embodiment of the thruster with plane parallel parts.

Referring now to FIG. 1, a preferred embodiment of a plasma thruster is comprised of: an anode gas-distributor 1 with gas distributing cavities 15 and feedthrough holes 16 for gas supply; a cathode 2; a discharge chamber 3 with exit end parts of internal wall **3*a* and of external wall 3*b*; an internal magnetic screen 4; an external magnetic screen 5; an external pole 6 of the magnetic system, which can be assembled from the separate parts $6^{I}$, $6^{II}$, $6^{III}$, $6^{IV}$ (FIG. 3 and 4); an internal pole 7 of the magnetic system; a magnetic path 8; an internal source of magnetic field coil 9; an external source of magnetic field coil 10, which can be comprised of several coils ($10^{I}$, $10^{II}$, $10^{III}$, $10^{IV}$ FIG. 3 and 4); a central core 12 of the magnetic system; thermal screens (shields) 13; a tube 14 with a channel for a gas supply to the anode gas-distributor; and, a holder 17. The external pole 6 and the external magnetic screen 5 can be made with the slits 18 ($18^{I}$, $18^{II}$, $18^{III}$, $18^{IV}$ in FIG. 3 and 4). If the magnetic screens 4 and 5 are situated with a gap relative to the magnetic path 8, they are connected between themselves by bridges 19 (FIG. 2) made of a magnetically permeable material. The central core 12 can be constructed with a cavity 20. The discharge chamber 3 may have plane parallel regions 21 (FIG. 4). In these regions there are planes of symmetry I and II (FIG. 3 and 4), and a generatrix III (FIG. 1) of a cone tangent to the internal edge of the exit end part 3*b*** of the discharge chamber outer wall.

When operating the thruster symmetrical with respect to two mutually perpendicular planes I and II (FIG. 3 and 4) and with slots $18^{I}$, $18^{II}$, $18^{III}$, $18^{IV}$, the external pole 6 and the external screen 5 should be comprised of parts (for example, $6^{I}$, $6^{II}$, $6^{III}$, $6^{IV}$ in FIG. 3 and 4) symmetrical with respect to the planes I and II. Thus, the external sources of magnetic field 10 should be constructed in four groups of magnetic coils ($10^{I}$, $10^{II}$, $10^{III}$, $10^{IV}$ in FIG. 3 and 4); each of the magnetic coils 10 in the magnetic circuit is connected with one of the external pole parts $6^{I}$, $6^{II}$, $6^{III}$ and $6^{IV}$.

The aforementioned conditions should also be preserved in the case when the discharge chamber 3 is made with the plane parallel parts 21 (FIG. 4). In this case, the thruster is constructed with elongated pole parts $6^{I}$ and $6^{III}$ and a larger quantity of coils $10^{I}$ and $10^{III}$ (FIG. 3 and 4). The central core 12 can be made with several cavities 20, and each one may have the cathode 2 (FIG. 4). It is evident that for a side placement, several cathodes 2 can be installed.

The discharge chamber 3 is preferably made out of thermally stable ceramic material with the annular accelerating channel formed by its walls. The anode gas-distributor 1, the holder 17 and the thermal screens 13 are made of thermally stable, metallic, non-magnetic material, for example, stainless steel. A high temperature stable wire is used to make the magnetic coils 10. The magnetic path 8, the central core 12, and the cores of the magnetic coils 9 and 10 are constructed of a magnetically permeable material.

The cathode 2 can be located at the side of the discharge chamber 3, or can be placed centrally to the discharge chamber 3 (FIG. 1). In the central placement, the cathode 2 is in the cavity 20 of the central core 12. The magnetic screens 4 and 5 together with the magnetic path 8, or with the bridges 19, cover all but the exit part 3*a*, 3*b* of the walls of the discharge chamber 3.

For the effective operation of the thruster it is preferred that the linear gaps $\Delta_1$ and $\Delta_2$ between the screens 4 and 5 and poles 7 and 6 (internal and external, respectively) do not exceed half of the distance $\Delta$ between the poles 6 and 7. It is preferable to construct the magnetic system in such a way that the internal pole 7 is placed a distance $\Delta_4$ from the middle point of the accelerating channel that exceeds the distance $\Delta_3$ from the internal magnetic screen 4 to the middle point of the accelerating channel. The exit end parts 3*a* and 3*b* of the discharge chamber 3 have an increased thickness (S2 and S1, respectively, in FIG. 1). The end parts 3*b* and 3*a* of the discharge chamber are extended the distances $\Delta_5$ and $\Delta_6$, respectively, relative to the planes tangent to the exit surfaces of the magnetic system poles 6 and 7, respectively.

The holder 17 is in contact with the discharge chamber 3 and the magnetic system only in the places of direct contact, (i.e., the holder 17 represents a thermal resistance). The thermal screens 13 cover the discharge chamber 3 and shield the magnetic system from the heat flow from the side of the discharge chamber 3.

In the case of the central placement of the cathode 2, one end of the cathode 2 is situated near the plane tangent to the edge of the wall behind the discharge chamber 3 (FIG. 2), in other words, a distance $\Delta_7$ (FIG. 1 and FIG. 2) from the cathode exit end to the plane in the acceleration direction must not exceed $0.1d_c$, (FIG. 2) where $d_c$ is the cathode 2 diameter. Using a side or external cathode placement, the cathode 2 is situated outside of the region of intensive influence of tile accelerated flow of ions. For this purpose, it is sufficient to place the cathode 2' outside an imaginary cone having a half angle of opening equal to 45°, the cone surface with a generatrix III (FIG. 1) tangent to the internal rim of the exit end part 3*b* of the discharge chamber external wall, and a cone apex inside the thruster volume.

Figure 2:
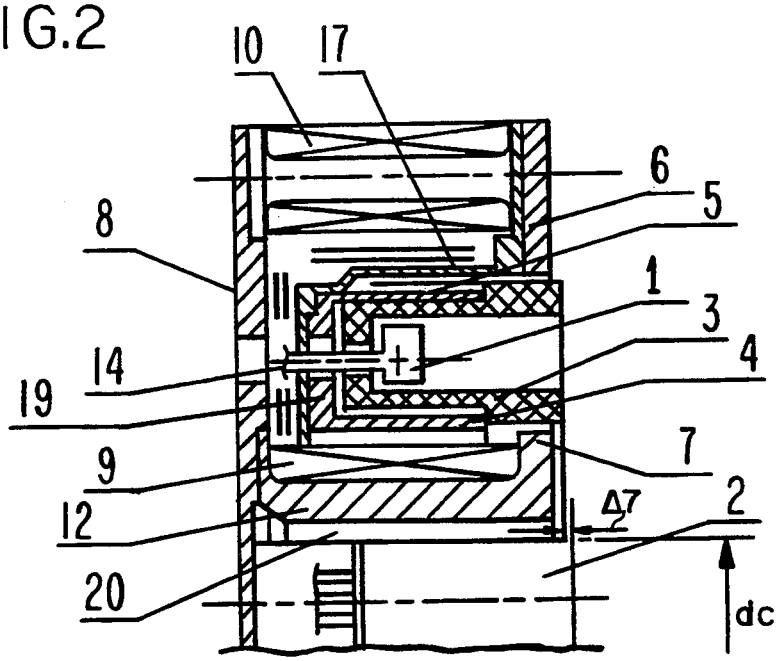
FIG. 2 is a cross-sectional view of the structure shown in FIG. 3 with less detail taken along the line I—I, showing a plasma accelerator with magnetic screens placed with a gap relative to the magnetic path.

The magnetic screens 4 and 5 in the thruster can be installed with a gap respective to the magnetic path and interconnected with at least one bridge 19 made of magnetically permeable material as shown in FIG. 2.

FIG. 3 illustrates one embodiment of a thruster with the discharge chamber 3, the anode 1, and the magnetic system, which are symmetrical relative to two mutually perpendicular linear planes I and II. Thus, the external pole 6 and the external magnetic screen 5 are designed with the opened cuttings symmetrical to the planes I and II, and dividing the pole 6 and screen 5 into four parts symmetrical to planes I and II. Note the external magnetic screen 5 has a finite thickness which is not shown on FIG. 3 to avoid cluttering the figure. The external sources of the magnetic field 10 are in the form of 4 groups of magnet coils, each placed in the magnetic path circuit and connected with one part of the external pole 6.

It is preferable to design the thruster such that the exit end parts 3*a* and 3*b* of the discharge chamber 3, the poles 6, 7, and the magnetic screens 4, 5 are located in parallel planes perpendicular to the acceleration direction. As shown in FIG. 4 a cavity 20 is created by the central core 12 of the magnetic path and the internal pole 7. The cathode 2 is placed in the cavity and the cathode exit end located with respect to the discharge chamber end at a distance not more than $0.1d_c$, where $d_c$ is the cathode diameter.

It is preferable to construct the thruster in such a way that the discharge chamber 3 is fastened to the external pole of the magnetic system 6 by a holder 17. The holder 17 is connected to the discharge chamber 3 proximate the front part and is situated between the external magnetic screen 5 and the discharge chamber 3 with a gap 25 between the latter except for the point of their connection.

The thruster operates in the following way. The sources of the magnetic field 9 and 10 create in the exit part of the discharge chamber 3 a mainly radial magnetic field (transverse to the acceleration direction) with induction B. The electric field with strength E along the acceleration direction is developed by applying a voltage between anode 1 and cathode 2. The working gas is supplied through the tube 14 to the gas distributing cavities 15 inside the anode 1, which balance the gas distribution along the azimuth (anode ring), through the channel holes 16, and pass the gas into the accelerating channel. To start the thruster, a discharge is ignited in the hollow cathode 2. The applied electric field gives the possibility for electrons to come into the accelerating channel. The existence of crossed electric and magnetic fields causes an electron drift, and their average movement is reduced to a movement along the azimuth (perpendicular to E and B) with a drift velocity $u=E\times B/B^2$. The collisions of the drifting electrons with atoms, ions, and the walls of the discharge chamber 3 lead to their gradual drift (diffusion) toward the anode 1. This electron drift is accompanied by the electrons acquiring energy from the electric field. At the same time, the electrons lose part of their energy because of non-elastic collisions with atoms, ions, and the walls of the discharge chamber 3. The balance of energy acquisition and loss determines the average values of electron energy, which at sufficiently high voltages $U_d$ between cathode 2 and anode 1, and the electric field strength E, can be sufficient for effective gas ionization. The generated ions are accelerated by the electric field and acquire velocities corresponding to the potential difference ΔU from the place of ion formation to the plasma region beyond the accelerating channel cross-section. Thus, $$v=(2q\Delta U/M)^{\frac{1}{2}},$$

where q and M are the ion charge and mass, respectively. The accelerated ion flow at the thruster exit attracts an amount of electrons necessary for a neutralization of the space charge. The ion flow out of the thruster creates the thrust. The special feature of the thruster is that ion acceleration is realized by the electric field in a quasi-neutral media. That is why the measured ion current densities, j (roughly 100 mA/cm$^2$ and more), significantly exceed the current densities in the electrostatic (ion) thrusters at comparable voltages (roughly 100–500 V).

To achieve the high thruster efficiency, it is necessary to develop a certain magnetic field topography in the accelerating channel. To ensure a stability of the accelerated flow, it is necessary to create in the discharge channel a region with the magnetic field strength increasing in the acceleration direction. In addition, the configuration of the magnetic field force lines, which determines the pattern of the electric field equipotentials in the first approximation, must be focusing.

Experiments by the inventors have shown the necessary conditions outlined above can be ensured if the magnetic path 8 of the magnetic system is used with the additional internal and external magnetic screens 4 and 5, respectively, made of magnetically permeable material. The internal screen 4 covers the internal source of the magnetic field 9 and is located with a longitudinal gap relative to the internal pole 7 defined by Δ2 (FIG. 1). The external screen 5 is made with the end part located inside of the external source of the magnetic field 10 covering, at least, the exit part of the walls of the discharge chamber 3 and placed with a longitudinal gap relative to the external pole 6 defined by Δ1 (FIG. 1).

A magnetic system of such design is far more capable of controlling magnetic field topography in the accelerating channel than earlier magnetic systems because screening a larger part of the accelerating channel allows for decreases in the magnetic field strength within the accelerating channel. Moreover, experiments have shown the magnetic system contemplated allows for necessary magnetic fields at increased gaps Δ between poles 6 and 7, if the gap values Δ1 and Δ2 between the end sides of magnetic screens 4 and 5 and corresponding poles 7 and 6 do not exceed Δ/2 (FIG. 1). If the gaps are increased more than Δ/2, a gradual lowering of thrust efficiency occurs. The best results are achieved by minimizing the radial separation between exit end parts of magnetic screens 4 and 5, that is at the closest location to the discharge chamber 3 allowed by the design. The minimal size of gaps Δ1 and Δ2 depends on the pole 6, 7 sizes, and on the ratio of distances between the screens' end parts (Δ3 on FIG. 1) and corresponding poles (Δ4 on FIG. 1) up to the channel half-length. Further movement of poles from the channel half-length, permits smaller longitudinal gaps between the screens 4 and 5 and the corresponding poles 7 and 6. It is also natural, when dealing with chosen sizes of poles 7, 6 and screens 4, 5, that the distances must be such that there will be no magnetic saturation of the screen material. The proper distances can be checked by calculations or by experiments.

The optimization of the magnetic field structure improves the focusing of the flow and decreases the general interaction intensity of the accelerated plasma flow with the discharge chamber walls. This results in an increase in thrust efficiency, a decrease in degradation, and, correspondingly, an increase in thruster lifetime and a decrease in the flow of sputtered particles (contamination) from the walls. Higher thruster efficiency with an increased gap between the poles Δ allows increased thicknesses of the discharge chamber exit walls (∂1 and ∂2 on FIG. 1), thus prolonging the thruster lifetime. The suggested magnetic system with screens also allows the exit end parts 3*a*, 3*b* of the discharge chamber 3 to move forward outside the pole plane to the distances Δ5 and Δ6 (FIG. 1), thus protecting the poles 6, 7 of the magnetic system from sputtering by the peripheral ion flows. Note that non-significant values of transverse and back ion flows is an important feature of the thruster operation.

The thruster efficiency can be increased if its scheme and design allow transverse deflection of the accelerated plasma flow. To realize such a deflection there are different schemes. In one suggested version, the division of the external pole 6 and the magnetic screen 5 allow a flow deflection with little change of other elements of construction. The flow deflection is achieved because it is possible to develop different configurations of the magnetic field lines in different sections along the azimuth. For example, to increase the magnetizing currents in the coils of $\mathbf{10}^{I}$ (see FIG. 4) and decrease the magnetizing currents in the coils of $\mathbf{10}^{II}$ with respect to their nominal values, one can observe the configuration of magnetic field when the ion flow in the upper part of the channel will be more deflected toward the plane II, and in the lower part of the channel the flow will be deflected away from the plane II (FIG. 4). As a result, the thrust vector of the thruster will be deflected from up to down (FIG. 4) from its nominal position. Experiments by the inventors have shown that it is possible to deflect the thrust vector 1°–1.5° without any considerable decrease in thrust efficiency or thruster lifetime. Such deflection can be used to adjust the thrust vector and in many cases can considerably increase the efficiency of the thruster.

A typical configuration is a thruster with plane ends of the sides of tile discharge chamber 3 as the plane. The central core cavity, and the placement of the cathode in it, allows an increase of the azimuthal (in the direction of the electron drift) uniformity of the discharge, and greater efficiency of the thruster, though not significantly (i.e., several percent). It is appropriate to place the cathode exit side near the plane tangent to the plane of the wall end side of the discharge chamber. If the cathode 2 is extended from the central cavity to a distance exceeding. $0.1d_c$, intensive erosion of the cathode external parts by accelerated ions of the main flow results. However, placing the cathode 2 in a cavity deeper than $0.1d_c$, leads to a sharp increase of the discharge voltage to ignite the thruster.

The fastening of the discharge chamber 3 with a special holder 17 to the external pole 6 of the magnetic system improves the thruster thermal scheme. Actually, the main heat release takes place in the discharge chamber 3. That is why the introduction of the thermal resistance (through holder 17), and screens 4 and 5 between the discharge chamber 3 and the magnetic system, decreases the heat flow from the discharge chamber 3 to the magnetic system. It also improves the conditions of thermal release from the magnetic system due to the usage of a large surface of the external pole 6, and decreases the high temperature level due to the immediate heat removal directly to the heat disposal element. This effects a decrease in the energy loss of the magnetic system and an increase of its lifetime.

So, as a whole, the suggested invention increases the efficiency and the lifetime of the thruster, and decreases the amount of impurities in the flow due to the sputtering of the elements of construction.

Based on the above disclosure, experimental and test samples of thrusters with a thrust efficiency $h_T \times 0.4$–$0.7$ and with flow velocities $v=(1-3)\ 10^4$ m/sec and having a lifetime of 3000–4000 hours and more, have been confirmed by tests.

Although the invention has been described with reference to preferred embodiments, the scope of the invention should not be construed to be so limited. Many modifications may be made by those skilled in the art with the benefit of this disclosure without departing from the spirit of the invention. Therefore, the invention should not be limited by the specific examples used to illustrate it, but only be the scope of the appended claims.

What is claimed is:

1. A thruster with closed electron drift having improved efficiency and lifetime, said thruster comprising:

a discharge chamber having an exit part and forming an annular accelerating channel facing said exit part of said discharge chamber, said accelerating channel formed by closed equidistant cylindrical working surfaces of internal and external walls of said discharge chamber;

an annular anode gas-distributor having channels for receiving gas from a supply and channels sending gas to the accelerating channel via a system of feedthrough holes in the accelerating channel, said annular anode gas-distributor placed inside the accelerating channel at a distance from an exit plane of the discharge chamber exceeding an accelerating channel width;

a magnetic system for producing substantially radial magnetic fields in the discharge chamber having at least one internal and at least one external source of magnetic fields, an external pole and an internal pole, with an operating gap, said external pole positioned proximate the exit part of the discharge chamber walls and outside an outer wall of the discharge chamber, said internal pole positioned proximate the exit part of the discharge chamber and inside an inner discharge chamber wall;

a magnetic path having a central core, said magnetic path having said at least one internal and said at least one external source of magnetic field positioned in said magnetic path at the internal and external poles, respectively;

an internal magnetic screen of magnetic permeable material that covers the internal source of the magnetic field, said internal magnetic screen placed with a first longitudinal gap relative to the internal pole, said first longitudinal gap not exceeding half the distance of the operating gap between the internal and external poles, said internal magnetic screen having an exit end, and an external magnetic screen made of magnetic permeable material situated between the discharge chamber and the external source of magnetic field, said external magnetic screen substantially surrounding the discharge chamber, said external magnetic screen placed with a second longitudinal gap relative to the external pole, said second longitudinal gap not exceeding half the distance of the operating gap between the internal and external poles; and a gas discharge hollow cathode positioned outside the region of the accelerating channel.

2. The thruster of claim 1, wherein: the internal pole is farther from the middle point of the annular accelerating channel than the exit end of the internal magnetic screen;

the exit part of the internal and external walls of the discharge chamber are substantially flared; and the exit parts of each of the internal and external walls of the discharge chamber extend beyond the planes formed by terminating surfaces of the internal and external poles.

3. The thruster of claim 1, wherein the internal and external magnetic screens are placed with a gap relative to the magnetic path, and wherein said internal and external magnetic screens are joined by a bridge made of magnetically permeable material.

4. The thruster of claim 1, wherein the discharge chamber, the annular anode gas-distributor, and the magnetic system are made symmetrical relative to two mutually perpendicular longitudinal planes;

wherein the external pole and the external magnetic screen are formed with four opened slits dividing the external pole and the external magnetic screen into four symmetrical parts relative to said two mutually perpendicular longitudinal planes; and the external sources of the magnetic field are four groups of magnetizing coils, each coil placed in the magnetic path and coupled to one part of the external pole.

5. The thruster of claim 1, wherein:

terminating surfaces of each of the exit parts of the discharge chamber, the internal pole, the external pole, the internal magnetic screen, and the external magnetic screen are situated in parallel planes perpendicular to the acceleration direction;

the central core of the magnetic path and the internal pole define a cavity; and the cathode is placed in said cavity, said cathode having an exit end situated relative to the plane of the end part of the discharge chamber at a distance not more than a tenth of the cathode diameter.

6. The thruster of claim 1, wherein the discharge chamber is fastened to the external pole of the magnetic system by a holder connected to a front part of the discharge chamber and placed, with the exception of the location of connection, with a gap relative to the discharge chamber.

* * * * *